United States Patent [19]

Yamazaki

[11] Patent Number: 4,810,928

[45] Date of Patent: Mar. 7, 1989

[54] CATHODE-RAY TUBE FOR CONSTITUTING LARGE PICTURE DISPLAY APPARATUS

[75] Inventor: Eiichi Yamazaki, Ichihara, Japan

[73] Assignee: Hitachi, Ltd., Tokyo, Japan

[21] Appl. No.: 558,275

[22] Filed: Dec. 5, 1983

[30] Foreign Application Priority Data

Dec. 6, 1982 [JP] Japan ..... 57-212786
Dec. 8, 1982 [JP] Japan ..... 57-213916

[51] Int. Cl.[4] ..... H01J 29/10; H01J 29/48

[52] U.S. Cl. ..... 313/441; 313/461; 358/240

[58] Field of Search ..... 313/409, 415, 441, 470, 313/461, 474, 495; 358/64, 65, 240, 242; 315/9; 340/720, 721

[56] References Cited

U.S. PATENT DOCUMENTS 2,681,946 6/1954 Leverenz ..... 358/64 X
3,573,528 4/1971 Maeda ..... 313/458
4,317,065 2/1982 Hughes ..... 313/409
4,368,485 1/1983 Midland ..... 358/240

FOREIGN PATENT DOCUMENTS 133752 8/1983 Japan ..... 313/495

*Primary Examiner*—David K. Moore
*Assistant Examiner*—K. Wieder
*Attorney, Agent, or Firm*—Antonelli, Terry & Wands

[57] ABSTRACT

In a CRT for constituting a display apparatus in which the fluorescent screen is composed of a large number of CRTs arranged in the matrix form, a plurality of holes for passing an electron beam are provided in an electrode for controlling the electron beam which is so placed as to confront the cathode for emitting the electron beam, for the purpose of attaining improved modulation characteristics and a simplified drive circuit requiring lower power consumption. A plurality of fluorescent screens having individual luminous colors are formed on respective portions obtained by dividing the inside of the panel of said CRT and individual electron beams are respectively applied to those fluorescent screens, resulting in a picture of good quality because of increased picture elements.

10 Claims, 3 Drawing Sheets

CATHODE-RAY TUBE FOR CONSTITUTING LARGE PICTURE DISPLAY APPARATUS

BACKGROUND OF THE INVENTION

1. Field of the Invention

The present invention relates to a cathode-ray tube (CRT) used for constituting a display apparatus which forms a large or gigantic picture to be seen by a great number of people in grounds or the like.

2. Description of the Prior Art

It is known that a large number of, say, approximately 30,000 CRTs 1 are arranged in the matrix form to constitute a display apparatus as illustrated in FIG. 1 and the intensity of illumination of each CRT constituting one picture element is so controlled as to display a gigantic picture collectively.

A current of several milliamperes is let flow through a CRT constituting a conventional display apparatus. Accordingly, the video drive voltage of several tens volts is required for driving the intensity of illumination at the fluorescent screen. Since an extremely large number of CRTs are installed, a large number of drive circuits are also required. As a result, a large total power is required, resulting in poor economy.

It is also known that a conventional color display apparatus is composed of a number of, say approximately 30,000 colored but monochrome tubes 11 arranged in a matrix form as illustrated in FIG. 2 and the intensity of illumination of each colored but monochrome tube is so controlled that the apparatus as a whole may display a gigantic picture. In such a color display apparatus, colored but monochrome tubes 11 respectively radiating blue (B), green (G) and red (R) monochromatic lights are alternately arranged as illustrated in FIG. 2 to display a gigantic color picture.

In such a conventional color display apparatus, however, one CRT radiates a monochromatic light and three CRTs (G, B and R) constitute one picture element. Accordingly, three times as many color tubes as picture elements are necessitated. Thus, the total number of color CRTs is large, resulting in a high cost. In addition, such a conventional color display apparatus has a drawback that its size can not be reduced because of difficulty in reducing the size of a picture element.

SUMMARY OF THE INVENTION

A main object of the present invention is to provide a CRT constituting a display apparatus which facilitates simplification and low power consumption of the drive circuit associated thereto. To attain this object, a plurality of holes for passing electron beams are formed on the control electrode of an electron gun for the purpose of improving modulation characteristics of the electron beams.

A further object of the present invention is to provide a compact, inexpensive CRT for constituting a color display apparatus which yields a picture of good quality because of increased picture elements with respect to the number of CRTs. To attain the object, in accordance with the present invention, a plurality of monochromatic lights are radiated from one color CRT to form one picture element.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

Figure 1:
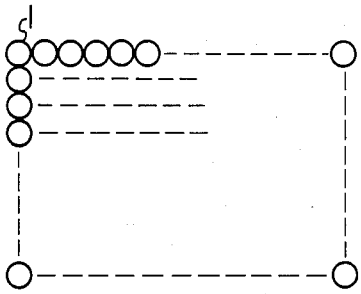
FIG. 1 PRIOR ART
FIG. 1 is a front view of a display apparatus constituted by conventional CRTs.
Figure 2:
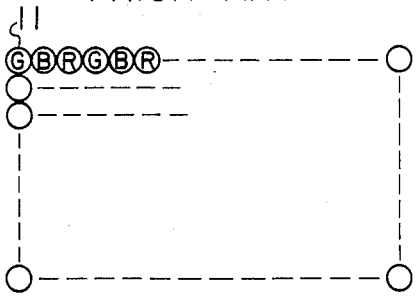
FIG. 2 PRIOR ART
FIG. 2 is a front view of a color display apparatus constituted by a conventional way.
Figure 3:
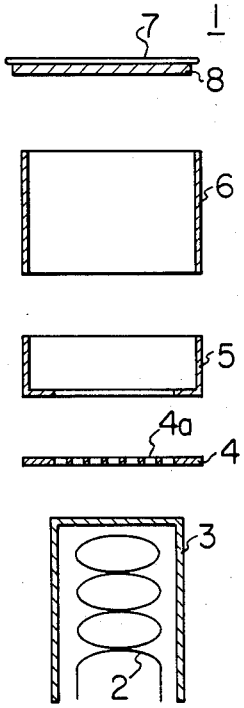
FIG. 3 is a sectional view for illustrating the composition of an electron gun assembly included in an embodiment of a CRT for constituting a display apparatus according to the present invention.

A CRT for constituting a display apparatus according to the present invention will now be described in detail by referring to the following embodiments. FIG. 3 is a sectional view for illustrating the composition of an electron gun assembly included in an embodiment of a CRT for constituting a display apparatus according to the present invention. In FIG. 3, reference numeral 2 denotes a heater, and 3 denotes a cathode which is heated by the heater 2 to emit an electron beam. Reference numerals 4, 5 and 6 denote a first grid which functions as a control electrode for modulating and controlling the amount of the electron beam, a second grid for accelerating the electron beam, and a third grid for accelerating the beam, respectively. Although not illustrated in FIG. 3, the electron gun assembly is housed in the neck portion of a bulb. The accelerated electron beam is applied to a monochromatic fluorescent screen 8 formed on the inside surface of a panel 7 illustrated at the top of FIG. 3. That is to say, one CRT in FIG. 1 constitutes a monochromatic picture element.

Figure 4:
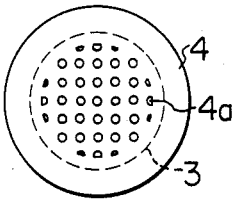
FIGS. 4, 5 and 6 are a variety of plan views of a first grid illustrated in FIG. 3.

FIG. 4 shows the plan view of the first grid 4. As illustrated in FIG. 4, on the surface of the first grid 4 confronting the cathode 3, a plurality of holes **4*a*** for passing an electron beam are formed.

Under such configuration, an electron beam emitted by the cathode 3 passes through holes **4*a* of the first grid 4. Thereafter, the electron beam is accelerated by the second grid 5 and the third grid 6 to be applied to the fluorescent screen 8. In passing through the holes 4*a*, the electron beam is modulated by the voltage at the first grid 4 with respect to the cathode 3, changing the luminance at the fluorescent screen 8 correspondingly. Since the electron beam passes through a number of holes 4*a*, modulation characteristics are largely improved in accordance with the number of holes. The required driving power may be reduced to a few tenths as compared with the prior art. The drive circuit may also be simplified. Since the electron beam passes through a number of holes 4*a*, a flood beam (nonconvergent beam) is obtained instead of a fine beam. For a CRT constituting a picture element of a display apparatus, however, it is not necessary to form a sharp spot on the fluorescent screen 8. Therefore, it offers no problem that such a flood beam (nonconvergent beam) forms an unclear spot on the fluorescent screen 8**.

Figure 5:
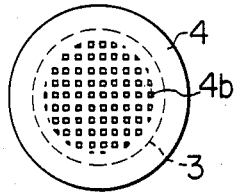
Figure 6:
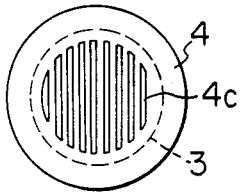

In the example illustrated in FIG. 5, holes 4*b* for passing the electron beam are formed reticulately on the first grid 4. In the example illustrated in FIG. 6, holes 4*c* shaped like slits are formed in the form of lattice on the first grid 4. In the foregoing embodiments, holes are made in the plate of the first grid 4. Alternatively, holes of the first grid 4 for passing the electron beam may be produced by netting wires composed of tungsten or the like to form meshes or lattices. It is a matter of course that other embodiments such as those described above yield operation and effect similar to those obtained in the embodiment illustrated in FIG. 3.

Figure 7:
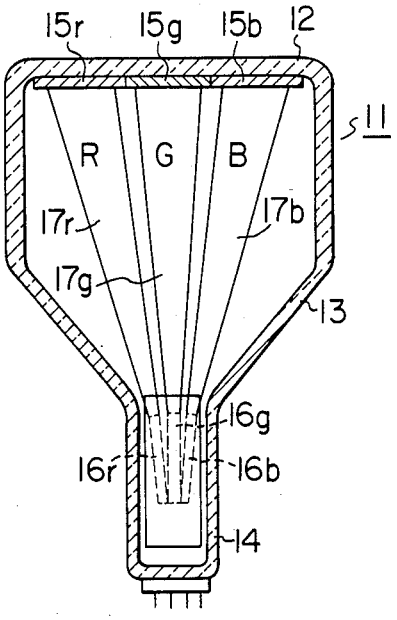
FIG. 7 is a schematic sectional view of another embodiment of a CRT constituting a display apparatus according to the present invention.

FIG. 7 is a schematic sectional view of another embodiment of a CRT constituting a display apparatus according to the present invention. In FIG. 7, reference numerals 12, 13 and 14 denote a panel section, a funnel section, and a neck section, respectively. The area of the interior surface of the panel section 12 is divided into three nearly equal divisions. On each of the three divisions, a red luminous fluorescent screen 15*r*, a green luminous fluorescent screen 15*g*, and a blue luminous fluorescent screen 15*b* are coated, respectively. Within the neck section 14 confronting the fluorescent screens 15*r*, 15*g* and 15*b*, an electron gun assembly 16*r* for red luminance, an electron gun assembly 16*g* for green luminance, and an electron gun assembly 16*b* for blue luminance are arranged. From these electron gun assemblies 16*r*, 16*g* and 16*b*, three electron beams 17*r*, 17*g* and 17*b* are emitted, respectively. These three electron beams 17*r*, 17*g* and 17*b* which are independently subject to luminance control are applied to the fluorescent screens 15*r*, 15*g* and 15*b*, respectively. Since these electron beams may be flood beams (non-convergent beams), deflection is unnecessary unlike the conventional CRTs. Therefore, any deflection device is not provided.

In the conventional technique for attaining self convergence or for automatically converging three electron beams respectively emitted from electron gun assemblies 16*r*, 16*g* and 16*b* which are composed of three in-line electron guns arranged in parallel to the central part of the fluorescent screens 15*r*, 15*g* and 15*b*, the electrode holes are provided with such offsets that three electron beams may converge to a point on the fluorescent screens 15*r*, 15*g* and 15*b*. It is also permitted to separate three electron beams when applied onto the fluorescent screens 15*r*, 15*g* and 15*b* so as to apply the electron beams 17*r*, 17*g* and 17*b* to the fluorescent screens 15*r*, 15*g* and 15*b* respectively by utilizing the above described conventional technique and providing the electrode holes with offsets which are obtained by inverting the above described offsets.

Although three electron beams 17*r*, 17*g* and 17*b* are flood beams, they are not permitted to mix with each other on the fluorescent screens 15*r*, 15*g* and 15*b*. In such a case, it is also possible to provide electron guns with light focusing function.

Figure 8:
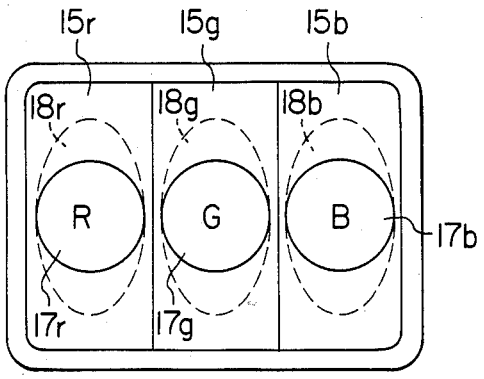
FIGS. 8 and 9 are front views of the inside of a panel wherein square-shaped color CRTs are used as the CRT illustrated in FIG. 7.
Figure 9:
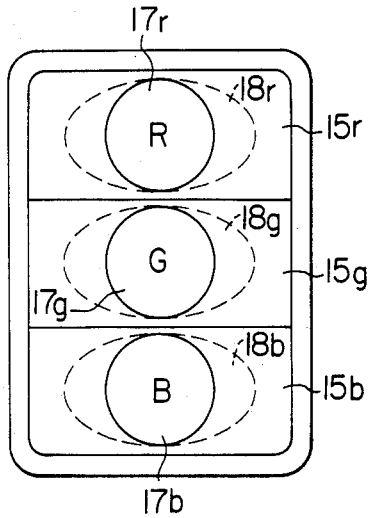
Figure 10:
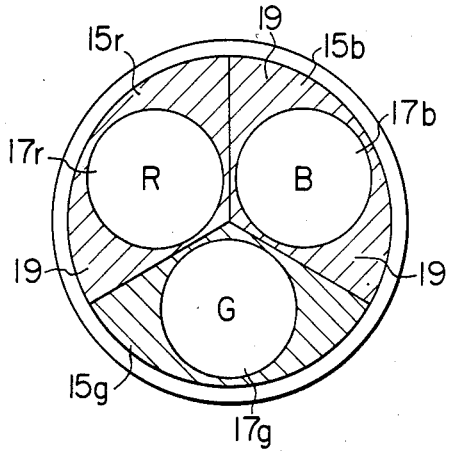
FIG. 10 is a front view of the inside of a panel wherein a round-shaped color CRT is used as the CRT illustrated in FIG. 7.

FIG. 8 is a front view of the inside of the panel 12 when square-shaped CRTs are arranged side by side. FIG. 9 is a front view of the inside of the panel 12 when square-shaped CRTs are piled up. FIG. 10 is a front view of the inside of the panel when round-shaped CRTs are used. Referring to FIG. 8 and FIG. 9, the portion on each fluorescent screen whereto each electron beam is applied is round-shaped. Accordingly, useless portions whereto the electron beam is not applied are generated above and below the circle. It is also possible to use the fluorescent screens 15*r*, 15*g* and 15*b* more effectively by forming oval electron beams 18*r*, 18*g* and 18*b* as illustrated by dotted lines. In the embodiment illustrated in FIG. 10, the electron beam takes the form of a dot and the fluorescent screen may be used effectively. When round-shaped CRTs are arranged, non-luminous screens 19 as represented by shaded regions are generated between respective panel surfaces. Making this portion 19 black-colored yields an effect similar to that of a black matrix, the picture contrast being enhanced.

As heretofore been described, in the CRT constituting a display apparatus according to the present invention, modulation characteristics may be largely improved by providing a plurality of holes for passing an electron beam on the control electrode. Accordingly, the video drive voltage for controlling the intensity of illumination of the fluorescent screen may be reduced to several volts. Thus, the video drive circuit may be simplified and the power consumption may be reduced. Since the number of CRTs constituting a display apparatus is extremely large, the effect per CRT is accumulated to yield a great effect as a whole.

Further, in case a number of color CRTs are arranged to constitute a color display apparatus, it is possible to constitute one picture element composed of a plurality of colors such as green, blue and red by using only one color CRT. Therefore, the number of color CRTs may be reduced to a few tenths as compared with the prior art. That is to say, the number of picture elements with respect to the number of color CRTs may be increased. As a result, a compact display apparatus yielding a picture of good quality may be realized.

I claim:

1. A CRT for constituting a large picture display apparatus in which a large number of CRTs are arranged to form a display screen, comprising:

an electron gun for emitting an electron beam; and the electrode for controlling said electron beam, said electrode being placed in front of said electron gun and having a plurality of holes for passing said electron beam;

wherein said electron gun emits a single electron beam, and said electrode for controlling said electron beam has a plurality of holes greater in number than said electron beam for passing said electron beam therethrough, whereby a picture element comprising one set of colors, red, green and blue is displaying on said CRT without a deflection means for said CRT being provided.

2. A CRT for constituting a large picture display apparatus according to claim 9, wherein each of said holes for passing said electron beam is round-shaped.

3. A CRT for constituting a large picture display apparatus according to claim 1, wherein said holes for passing said electron beam are formed reticulately.

4. A CRT for constituting a large picture display apparatus according to claim 1, wherein said holes for passing said electron beam are shaped like slits.

5. A CRT for constituting a large picture display apparatus in which a large number of color CRTs are arranged to form a display screen, comprising:

a fluorescent screen which is divided into a plurality of portions, respective portion illuminating with individual luminous colors; and a plurality of electron guns for emitting individual electron beams to said portions, respectively;

wherein said fluorescent screen is divided into three portions, respective portions illuminating with individual different luminous colors, and three electron guns being provided, one gun being provided for emitting an individual electron beam to one respective portion of said fluorescent screen.

6. A CRT for constituting a large picture display apparatus according to claim 5, wherein said fluorescent screen is composed of said three portions arranged side by side.

7. A CRT for constituting a large picture display apparatus according to claim 5, wherein said fluorescent screen is composed of said three portions piled up.

8. A CRT for constituting a large picture display apparatus according to claim 5, wherein said fluorescent screen is composed of said three portions arranged radially.

9. A CRT for constituting a large picture display apparatus according to claim 5, wherein each electron gun is arranged so that non-convergent electron beams are directed to the respective portions of said fluorescent screen without a deflection means being provided in the CRT.

10. A CRT for constituting a large picture display apparatus according to claim 5, wherein the three electron guns and the three portions of the fluorescent screen enable a display of one set of colors of red, green and blue on said CRT.

* * * * *